US009783890B2

(12) United States Patent
Yee et al.

(10) Patent No.: US 9,783,890 B2
(45) Date of Patent: Oct. 10, 2017

(54) PROCESS FOR ELECTROLESS PLATING AND A SOLUTION USED FOR THE SAME

(71) Applicant: Rohm and Haas Electronic Materials LLC, Marlborough, MA (US)

(72) Inventors: Dennis Kwok-Wai Yee, Yuen Long (HK); Michael Chi-Yung Tang, Tin Shui Wai (HK); Martin W. Bayes, Hopkinton, MA (US); Ka-Ming Yip, Tai Wai (HK); Chun-Man Chan, Tsuen Wan (HK); Hung-Tat Chan, Tin Shui Wai (HK); Tsui-Kiu Li, Kowloon (HK); Lok-Lok Liu, Kowloon (HK)

(73) Assignee: ROHM AND HAAS ELECTRONIC MATERIALS LLC, Marlborough, MA (US)

( * ) Notice: Subject to any disclaimer, the term of this patent is extended or adjusted under 35 U.S.C. 154(b) by 13 days.

(21) Appl. No.: 13/661,048

(22) Filed: Oct. 26, 2012

(65) Prior Publication Data

US 2014/0120263 A1 May 1, 2014

(51) Int. Cl.

| | |
|---|---|
| ***C23C 18/30*** | (2006.01) |
| ***C23C 18/16*** | (2006.01) |
| ***C23C 18/18*** | (2006.01) |
| ***C23C 18/20*** | (2006.01) |
| *C23C 18/38* | (2006.01) |

(52) U.S. Cl.

CPC ..... *C23C 18/1639* (2013.01); *C23C 18/1608* (2013.01); *C23C 18/1612* (2013.01); *C23C 18/1851* (2013.01); *C23C 18/204* (2013.01); *C23C 18/2086* (2013.01); *C23C 18/30* (2013.01); *C23C 18/38* (2013.01)

(58) Field of Classification Search

CPC ..... C23C 18/1633; C23C 18/1635; C23C 18/1639; C23C 18/1641; C23C 18/166

USPC ..... 427/304, 305, 306, 97.9, 99.5, 443.1; 106/1.11, 1.21

See application file for complete search history.

(56) References Cited

U.S. PATENT DOCUMENTS

| | | | | |
|---|---|---|---|---|
| 3,904,792 | A * | 9/1975 | Gulla et al. | 427/304 |
| 3,969,554 | A * | 7/1976 | Zeblisky | C23C 18/28 205/126 |
| 4,659,587 | A | 4/1987 | Imura et al. | |
| 5,376,248 | A | 12/1994 | Conrod et al. | |

(Continued)

FOREIGN PATENT DOCUMENTS

| | | | |
|---|---|---|---|
| CN | 101159181 | 4/2008 | |
| DE | WO 2010108795 A1 * | 9/2010 | H05K 3/244 |

(Continued)

OTHER PUBLICATIONS

Search report from corresponding Chinese 201310702945.3 application, dated Dec. 15, 2015.

(Continued)

*Primary Examiner* — Dah-Wei D Yuan
*Assistant Examiner* — Nga Leung V Law
(74) *Attorney, Agent, or Firm* — John Piskorski

(57) ABSTRACT

A process of pretreatment for selective application of electroless metallization to a surface of a non-conductive material and a solution useful for the pretreatment are provided. The process achieves good coverage in areas to be plated on the surface of non-conductive materials without skip plating or over plating.

4 Claims, 3 Drawing Sheets

(56) References Cited

U.S. PATENT DOCUMENTS

| | | | |
|---|---|---|---|
| 7,060,421 | B2 | 6/2006 | Naundorf et al. |
| 7,578,888 | B2 | 8/2009 | Schildmann |
| 7,645,370 | B2 | 1/2010 | Tai et al. |
| 8,591,636 | B2 | 11/2013 | Liu et al. |
| 8,900,666 | B2 | 12/2014 | Liu et al. |
| 2008/0081155 | A1 | 4/2008 | Kaneda |
| 2012/0021218 | A1 | 1/2012 | Lee et al. |

FOREIGN PATENT DOCUMENTS

| | | | |
|---|---|---|---|
| GB | 1299102 | A | 12/1972 |
| JP | 2003193247 | | 7/2003 |
| WO | WO 2010108795 | A1 * | 9/2010 |

OTHER PUBLICATIONS

Search report for corresponding European Application No. 13 19 0206 dated Jan. 5, 2017.
Search report for corresponding Europe Application No. 13 19 0206 dated Oct. 13, 2016.

* cited by examiner

PROCESS FOR ELECTROLESS PLATING AND A SOLUTION USED FOR THE SAME

FIELD OF THE INVENTION

The present invention relates to a process for pretreatment for electroless copper plating on a surface of a non-conductive material and a solution used for the process. More particularly, the present invention relates to a selective electroless plating process for the surface of a non-conductive material which has been locally modified either chemically or physically within the areas to be plated.

BACKGROUND OF THE INVENTION

Electroless plating has been employed for wide variety of substrates for many applications, including electronic device fabrication. The surfaces of such electronic devices often require the formation of a conductor pattern by metal plating. Recently, the Laser Direct Structuring Process (LDS) has been developed and used for the selective plating of molded plastic materials, so called Molded Interconnect Devices (MID). With LDS, it is possible to realize highly functional circuit layouts on complex 3-dimensional substrates. The basis of the process involves additive doped thermoplastics or thermosets with inorganic fillers, which allow the formation of circuit traces by means of laser activation, followed by metallization using electroless plating. The metal containing additives incorporated in such plastics are activated by the laser beam and become active as a catalyst for electroless copper plating on the treated areas of the surface of plastics to be plated. In addition to activation, the laser treatment may create a microscopically rough surface to which the copper becomes firmly anchored during metallization.

However, based on the investigations of the inventors, such substrates are not always easily metalized by a deposition process in which the parts are directly introduced into an electroless copper bath after laser treatment. To ensure that a deposit with the required copper thickness is formed on all areas which have been laser irradiated, a highly reactive electroless copper bath (so-called strike bath) is often needed to form a thin and uniform initial layer, and then the thickness of the copper layer is increased to the required value in another, more stable electroless copper bath (full build bath). Since the strike bath is often operated at conditions that lead to higher consumption of ingredients of the bath and at higher temperature than normal electroless copper baths, the bath life is shorter, leading to the inconvenience of frequently needing to prepare new strike baths.

U.S. Pat. No. 4,659,587 to Imura et al. discloses a selective electroless plating process on the surface of workpieces subjected to a laser beam treatment. The patent discloses that when laser irradiation disrupts the substrate, selective formation of a plated film on the substrate can be effected by immersing it directly in a chemical plating bath, without the need for preliminary activation treatment.

U.S. Pat. No. 7,060,421 to Naundorf et al. discloses a method for producing conductor track structures on a non-conductive material comprising spinel-based metal oxides. The molded non-conductive material disclosed in the document is irradiated by electromagnetic radiation such as from a Nd:YAG laser to break down and release metal nuclei that form patterns that can be plated. After treatment, the irradiated material was washed with water in an ultrasound cleaning bath, after which copper plating was conducted.

U.S. Pat. No. 7,578,888 to Schildmann discloses a method for treating laser-structured plastic surfaces. The patent discloses the laser structured substrates are contacted with a process solution that is suitable for removal of the unintentional deposited metal seeds, prior to introduction into an electroless plating bath, so as to reduce spurious plating in areas of the surface that were not treated with the laser.

However, when the inventors tried the methods disclosed in these US patents and conducted plating with conventional electroless copper plating baths on surfaces which had been laser irradiated, copper deposition on the circuit trace areas was not complete (skip plating). When the inventors used a conventional colloidal catalyst solution before electroless plating, copper was deposited not only on areas which had been laser irradiated but also in non-irradiated areas, so selective plating was not achieved (over plating). Therefore, there is a need for a process of improving the selective electroless metallization of MID-LDS substrates.

SUMMARY OF THE INVENTION

Inventors of this application have studied many kinds of chemicals and combination of these chemicals as ingredients of pretreatment solutions for selective electroless plating, and have now found that the specific combinations of chemicals provide good selectivity of electroless plating, i.e. good coverage, without skip plating or over plating, and an acceptable deposition rate for an industrial manufacturing process.

It is an object of the present invention to provide a process for selective metallization on a surface of a non-conductive material.

Another object of the present invention is a solution used for the process, comprising catalytic metal ion, an acid containing a sulfonate group and chloride ion, the weight ratio of catalytic metal ion to chloride ion in the solution is between 1 to 10 and 1 to 1000.

DETAILED DESCRIPTION OF THE INVENTION

Figure 1:
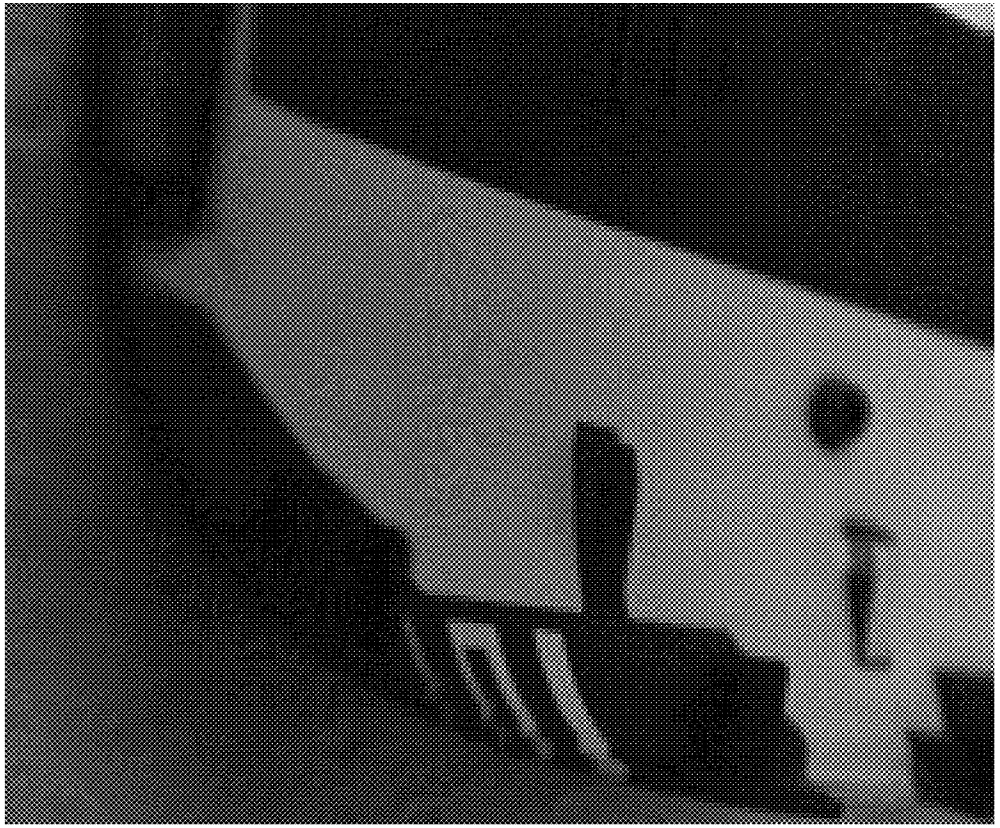
FIG. 1 is a photograph of a molded resin sample with good coverage of deposited copper.

As used throughout this specification, the abbreviations given below have the following meanings, unless the content clearly indicates otherwise: g=gram; mg=milligram; L=liter; m=meter; min.=minute; s=second; h.=hour; ppm=parts per million; g/L=grams per liter.

As used throughout this specification, the word "deposition", "plating" and "metallization" are used interchangeably. As used throughout this specification, the word "solution" and "bath" are used interchangeably. Unless the content clearly indicates otherwise, the solution and bath comprise water.

The process of the present invention relates to selective metallization of a surface of a non-conductive material. In this embodiment, the word 'selective metallization' means metallization (plating) only in those areas intended to be plated on a surface of a material, with substantially no deposition in the areas other than the intended areas. When the deposition in the areas intended to be plated is not sufficient (skip plating), the required conductive performance cannot be obtained. When there is substantial deposition in areas not intended to be plated (over plating), the functionality of the circuit path structure is degraded, thus causing problems in the electronic circuit due to short circuiting. The process comprises four steps.

The first step of the process is (a) preparing a surface of a non-conductive material by chemically or physically modifying the areas of the surface that are to be plated.

The non-conductive material is preferably a thermoset or thermoplastic. Examples of plastics which could be used as the non-conductive material include polycarbonate (PC), polyethylene telephtalate (PET), polybutylene terephthalate (PBT), polyacrylate (PA), liquid crystal polymer (LCP), (poly phthalamide?) (PPA), and acrylonitrile butadiene styrene copolymer (ABS) and mixtures thereof. Preferred plastics are molded plastics produced using the thermoplastics described above.

The non-conductive material optionally contains one or more inorganic fillers which are conventionally used, such as alumina, silicate, talc or derivatives thereof. The non-conductive material optionally contains one or more metal or metal compounds. Metal compounds include metal oxides, metal silicates, metal phosphates and metal chelates. The metal or metal compound is mixed with the non-conductive material, and a portion of those compounds emerge on the surface of the material after chemical or physical modification and become activated to behave as catalysts for the deposition of metals. Examples of metals include but are not limited to, precious metals such as palladium, transition metals such as copper, chromium, cobalt, iron, zinc and mixtures thereof. U.S. Pat. No. 7,060,421 discloses such materials.

The material is modified chemically or physically in the areas to be plated. Examples of chemical modification of the surface of the non-conductive material include etching by alkaline or acid solutions. Examples of physical modification include treatment by a laser such as a Nd:YAG laser. The areas to be plated are selected based on the requirements to form conductive traces on the surface of the materials. The chemical or physical modification creates a microscopically rough surface, useful for anchoring the deposited metal layer. Such materials are commercially available, such as from LPKF Laser and Electronic AG, Germany.

The second step of the process is (b) contacting the non-conductive material with a pretreatment solution comprising a conditioning agent and an alkaline material.

The pretreatment solution is a composition which shows the property of selectively enhancing absorption of catalyst material on the laser treated surfaces. Preferred conditioning agents include anionic surfactants and organic acids. The preferred compositions of anionic surfactants for the invention include polyoxyethylene alkyl phenol phosphate and polyether phosphate. The examples of preferred compositions of organic acid are alkyl sulfonic acids or aromatic sulfonic acids such as phenol sulfonic acid. The concentration for the conditioning agent depends on the kind of composition, but when an anionic surfactant is used as the conditioning agent, the preferred concentration is normally between 1 to 50 g/L, and more preferably 2.5 to 15 g/L. When a sulfonic acid, such as an aromatic sulfonic acid is used as the conditioning agent, the preferred concentration is normally 1 to 50 g/L, and more preferably 2.5 to 25 g/L.

The alkaline material is normally added as an alkali metal hydroxide. The concentration of alkali metal hydroxide in the pretreatment solution is normally, 1 to 200 g/L, and preferably, 10 to 90 g/L.

The pretreatment solution optionally contains a poly hydroxyl compound. The preferable concentration of this component is normally 0 to 100 g/L, and preferably 10 to 50 g/L. The pH of the solution is normally more than 12, and preferably, more than 13.

The method for contacting the material to be plated with the solution could be any kind of method, such as dipping or spraying. The conditions for contacting the material with the pretreatment solution are, for example, dipping the material in the solution at 40 to 90 degrees C. for 1 to 20 minutes. Preferably, the above step may be followed by a water rinse.

The third step of the process is (c) contacting the non-conductive material with a catalyst solution comprising a catalytic metal ion, an acid having at least one sulfonate group, and chloride ion. The catalytic metal ion is preferably a precious metal ion such as palladium ion. Any kind of palladium ion source can be used for the solution as long as the palladium ion source generates palladium ion in the solution. Examples of palladium ion sources comprise palladium chloride, palladium sulfate, palladium acetate, palladium bromide and palladium nitrate.

The acid having at least one sulfonate group comprises both organic acid and inorganic acid. Examples of organic acid include methane sulfonic acid, and examples of inorganic acid include sulfuric acid. Preferably the acid is sulfuric acid.

Any kind of chloride ion source can be used for the solution as long as the chloride ion source provides chloride ions in the solution. Examples of chloride ion sources comprise sodium chloride, hydrochloric acid and potassium chloride. The preferred chloride ion source is sodium chloride.

The preferred amounts of each ingredient in the solution is normally 1 to 50 ppm of catalytic metal ion, 50 to 150 g/L of sulfuric acid, and 0.1 to 10 g/L of chloride ion based on the weight of the solution. More preferably, the amount of each ingredient in the solution is 5 to 25 ppm of catalytic metal ion, 75 to 125 g/L of sulfuric acid, and 5 to 5.0 g/L of chloride ion based on the weight of the solution.

The ratio of catalytic metal ion to chloride ion in the solution is preferably between 1 to 10 and 1 to 1000, more preferably between 1 to 20 and 1 to 500, and further more preferably between 1 to 50 and 1 to 200. If the ratio of chloride ion is over 1000, skip plating may be observed. If the ratio of chloride ion is under 10, overplating may be observed.

Optionally, the solution of this invention may comprise one or more of a variety of additives used for pretreatment solutions for electroless plating, such as surfactants, complexing agents, pH adjusters, buffers, stabilizers, copper ions and accelerators. The pH of the solution is normally 0.2 to 2, preferably 0.2 to 1. Preferred surfactants used for this solution are cationic surfactants. The amount of surfactant depends on the kind of surfactant, but is normally 0.1 to 10 g/L based on the weight of the solution.

The method for contacting the solution could be any kind of method, such as dipping or spraying. The conditions for contacting the material with the catalyst solution are, for example, dipping the material in the solution at 20 to 80 degrees C., preferably 50 to 70 degrees C. for 1 to 20 minutes, preferably 5 to 20 minutes. Preferably, the above step may be followed by a water rinse.

The fourth step of the process is (d) electrolessly plating areas to be metalized on the surface of the non-conductive material. Electroless plating methods and compositions for plating copper are well known in the art. Conventional methods and electroless copper plating baths may be used. Examples of such copper baths include 1 to 5 g/L of copper ion, 10 to 50 g/L of complexing agent, 0.01 to 5 g/L of surfactant, 5 to 10 g/L of sodium hydroxide and 2 to 5 g/L of reducing agent. Conventional electroless copper baths may be used, such as CIRCUPOSIT™ 71 HS Electroless Copper, CIRCUPOSIT™ LDS 91 Electroless Copper available from Dow Electronic Materials.

The conditions for electroless plating are, for example, dipping the material in the electroless copper plating bath at 20 to 70 degrees C., preferably 45 to 65 degrees C. for a time sufficient to deposit the required thickness of copper, for example 20 to 300 minutes. Preferably, the above step may be followed by one or more water rinses.

The catalyst solution of this invention is useful as a pretreatment solution for selective electroless plating of a non-conductive material. The contents of the solution are same as the solution described in the third step. The weight ratio of catalytic metal ion to chloride ion in the solution is between 1 to 10 and 1 to 1000.

The process of this invention enables the elimination of the electroless copper strike bath used in a conventional process. The process enables direct metallization only within the specific areas to be plated on the surface of non-conductive materials. The materials obtained by the process of the present invention are selectively metalized only within those areas modified chemically or physically, i.e. with good coverage and uniform thickness, without over plating or skip plating. In addition, the deposition rate is acceptable for industrial processing.

EXAMPLES

Example 1

An LDS substrate sample made from a blend of PC and ABS (PC/ABS) resins was laser treated in those areas to be plated (LPKF Laser and Electronic AG). The substrate sample was dipped in a pretreatment solution containing 70 g/L NaOH and 5 g/L anionic surfactant (polyester phosphate, supplied by Dow Electronics Materials as TRITON™ QS-44 surfactant) for 5 minutes at 70 degrees C. The pH of the solution was approximately 14. After rinsing with deionized water, the substrate sample was dipped in a catalyst solution containing 18.4 mg/L palladium sulfate (9.5 ppm palladium ion), 60 mL/L 98% sulfuric acid and 1.7 g/L sodium chloride for 10 minutes at 69 degrees C. The substrate sample was then rinsed with deionized water, and electroles sly plated for 120 minutes at 56 degrees C. (CIRCUPOSIT™ 71 HS Electroless Copper, Dow Electronic Materials). The plated substrate sample was rinsed with water, and then rated by the standard described below. The thickness of the copper layer was 9 micrometers measured by X-ray Fluorescence (XRF) and rating of deposition quality was 5-5. FIG. 1 shows complete copper deposit on the laser treated surface.

Rating

The deposition of copper was observed using an optical microscope and rated from 1 to 5 both within the laser treated areas and the non-treated areas. The first digit indicated the performance within the laser treated areas, while the second digit indicated the performance in non-laser treated areas. In laser treated areas, "1" indicates there was no deposition and "5" indicates complete copper coverage with no skip plating. A rating of "3" indicates coverage of copper is not complete. Other rating numbers indicate behavior between these defined levels. In non-laser treated areas, "5" indicates there is no deposition on that area (no overplating) and "1" indicates a large amount of excess plating was observed (serious overplating). A rating of 5-5 indicates the best overall performance.

Example 2

The procedure of Example 1 was repeated except that the pretreatment solution containing 70 g/L NaOH and 5 g/L anionic surfactant was replaced with a pretreatment solution containing 39 g/L of NaOH and 17 g/L phenolsulfonic acid, and the dipping time of the pretreatment solution was changed from 5 minutes to 10 minutes. The thickness of the copper layer was 8.4 micrometers and the rating of deposition quality was 4-5.

Example 3

Figure 2:
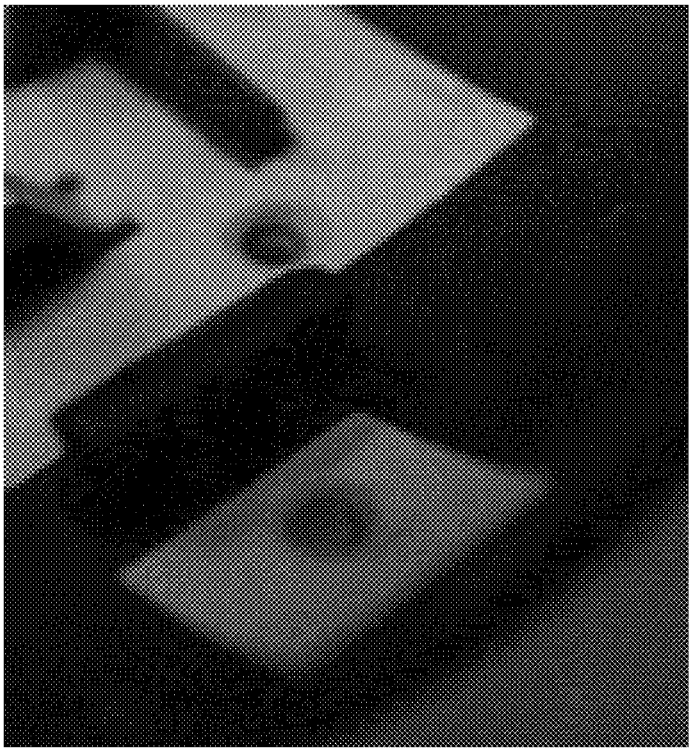
FIG. 2 is a photograph of a molded resin sample with slight skip plating.

The procedure of Example 1 was repeated except that the pretreatment solution containing 70 g/L NaOH and 5 g/L anionic surfactant was replaced with a pretreatment solution containing 30 g/L of NaOH, 8.7 g/L phenolsulfonic acid and 36.8 g/L glycerol, and dipping time of the pretreatment solution was changed from 5 minutes to 10 minutes. The thickness of the copper layer was 8.8 micrometers and the rating of deposition quality was 4.5-5. FIG. 2 shows complete copper coverage on the flat laser treated surface, but with slight skip plating in the hole area.

TABLE 1

| | | Example | | |
|---|---|---|---|---|
| | | 1 | 2 | 3 |
| Pretreatment solution | Polyester phosphate (g/L) | 5 | | |
| | Phenolsulfonic acid (g/L) | | 17 | 8.7 |
| | Glycerol (g/L) | | | 36.8 |
| | NaOH (g/L) | 70 | 39 | 30 |
| Dipping time of the pretreatment solution | | 5 | 10 | 10 |
| Catalyst solution | Palladium sulfate (mg/L) | 18.4 | 18.4 | 18.4 |
| | Sulfuric acid (mL/L) | 60 | 60 | 60 |
| | Sodium chloride (g/L) | 1.7 | 1.7 | 1.7 |
| Results | Thickness (micron) | 9 | 8.4 | 8.8 |
| | Rating | 5-5 | 4-5 | 4.5-5 |

Comparative Example 1

The procedure of Example 1 was repeated except that the pretreatment solution containing 70 g/L NaOH and 5 g/L anionic surfactant was replaced with a pretreatment solution containing 5 g/L of anionic surfactant. The thickness of the copper layer was 8.4 micrometers and the rating of deposition quality was 3-5.

Comparative Example 2

Figure 3:
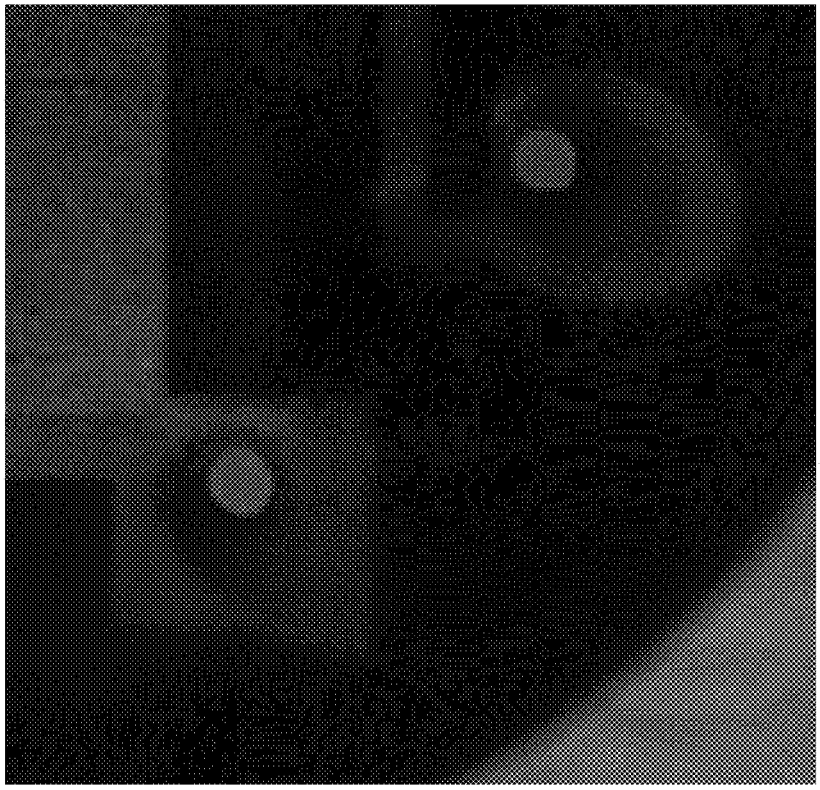
FIG. 3 is a photograph of a molded resin sample with no plating.

The procedure of Example 1 was repeated except the catalyst solution containing 18.4 mg/L palladium sulfate, 60 mL/L 98% sulfuric acid and 1.7 g/L sodium chloride was replaced with a catalyst solution containing 18.4 mg/L palladium sulfate and 60 mL/L 98% sulfuric acid. The thickness of the copper layer was 3.0 micrometers and the rating of deposition quality was 1-5. FIG. 3 shows no plating on the laser treated surface.

TABLE 2

| | | Comparative Example | |
|---|---|---|---|
| | | 1 | 2 |
| Pretreatment solution | Polyester phosphate (g/L) | 5 | 5 |
| | NaOH (g/L) | 0 | 70 |
| Catalyst solution | Palladium sulfate (mg/L) | 18.4 | 18.4 |
| | Sulfuric acid (mL/L) | 60 | 60 |
| | Sodium chloride (g/L) | 1.7 | 0 |
| Results | Thickness (micron) | 8.4 | 3.0 |
| | Rating | 3-5 | 1-5 |

What is claimed is:

1. A catalyst solution consisting of a) one source of catalytic palladium ions chosen from palladium chloride, palladium sulfate, palladium acetate, palladium bromide and palladium nitrate to generate the catalytic palladium ions in amounts of 1 to 50 ppm in the catalyst solution; b) an acid having at least one sulfonate group selected from the group consisting of methane sulfonic acid and sulfuric acid; c) one source of chloride ions chosen from sodium chloride, hydrochloric acid and potassium chloride to provide the chloride ions in the catalyst solution; and d) water; wherein a weight ratio of the catalytic palladium ions to the chloride ions in the catalyst solution is between 1 to 10 and 1 to 1000.

2. The catalyst solution of claim 1, wherein the weight ratio of the catalytic palladium ions to the chloride ions in the catalyst solution is between 1 to 20 and 1 to 500.

3. The catalyst solution of claim 1, wherein the weight ratio of the catalytic palladium ions to the chloride ions in the catalyst solution is between 1 to 50 and 1 to 200.

4. The catalyst solution of claim 1, wherein the catalytic palladium ions are in amounts of 5 to 25 ppm.

* * * * *